US006390769B1

(12) United States Patent
Burdgick et al.

(10) Patent No.: US 6,390,769 B1
(45) Date of Patent: May 21, 2002

(54) CLOSED CIRCUIT STEAM COOLED TURBINE SHROUD AND METHOD FOR STEAM COOLING TURBINE SHROUD

(75) Inventors: Steven Sebastian Burdgick, Schenectady, NY (US); Brendan Francis Sexton; Iain Robertson Kellock, both of Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/567,296

(22) Filed: May 8, 2000

(51) Int. Cl.[7] ..... F04D 31/00
(52) U.S. Cl. ..... 415/116; 415/175
(58) Field of Search ..... 415/115, 116, 415/175, 176, 177, 178

(56) References Cited

U.S. PATENT DOCUMENTS

| | | | | |
|---|---|---|---|---|
| 5,169,287 A | * | 12/1992 | Proctor et al. | 415/115 |
| 5,391,052 A | | 2/1995 | Correia et al. | |
| 5,480,281 A | | 1/1996 | Correia | |
| 5,964,575 A | * | 10/1999 | Marey | 415/115 |
| 6,146,091 A | * | 11/2000 | Watanabe et al. | 415/115 |

OTHER PUBLICATIONS

"39$^{th}$ GE Turbine State–of–the–Art Technology Seminar", Tab 1, "F" Technology—First Half–Million Operating Hours, H.E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA—An Advanced–Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderivative Gas Turbines—Design and Operating Features", M.W. Horner, Aug. 1996.

"39th GE Turbine State–of–the–Art Technology Seminar", Tab 7, "Advance Gas Turbine Materials and Coatings", P.W. Schilke, Aug. 1996.

"39th GE Turbine State–of–the–Art Technology Seminar", Tab 8, "Dry Low $NO_x$ Combustion Systems for GE Heavy–Duty Turbines", L. B. Davis, Aug. 1996.

"39th GE Turbine State–of–the–Art Technology Seminar", Tab 9, "GE Gas Turbine Combustion Flexibility", M. A. Davi, Aug. 1996.

(List continued on next page.)

*Primary Examiner*—Edward K. Look
*Assistant Examiner*—Ninh Nguyen
(74) *Attorney, Agent, or Firm*—Nixon & Vanderhye PC

(57) ABSTRACT

A turbine shroud cooling cavity is partitioned to define a plurality of cooling chambers for sequentially receiving cooling steam and impingement cooling of the radially inner wall of the shoud. An impingement baffle is provided in each cooling chamber for receiving the cooling media from a cooling media inlet in the case of the first chamber or from the immediately upstream chamber in the case of the second through fourth chambers and includes a plurality of impingement holes for effecting the impingement cooling of the shroud inner wall.

20 Claims, 4 Drawing Sheets

OTHER PUBLICATIONS

"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines,"J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology", J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2—Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176—11.
"Exhibit panels used at 1995 product introduction at Power Gen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.

"Gas, Steam Turbine Work as Single Unit in GE's Advanced Technology Combined–Cycle System", Press Information, Press Release, 95–NR18, May 16, 1995, Advanced Technology Introduction/pp. 1–3.

"GE Breaks 60% Net Efficiency Barrier" paper, 4 pages.

"GE Businesses Share Technologies and Experts to Develop State–of–the–Art Products", Press Information, Press Release 95–NR10, May 16, 1995, GE Technology Transfer/pp. 1–3.

"General Electric ATS Program Technical Review, Phase 2 Activities", T. Chance et al., pp. 1–4.

"General Electric's DOE/ATS H Gas Turbine Development" Advanced Turbine Systems Annual Review Meeting, Nov. 7–8, 1996, Washington, D.C., Publication Release.

"H Technology Commercialization", 1998 MarComm Activity Recommendation, Mar., 1998.

"H Technology", Jon Ebacher, VP, Power Gen Technology, May 8, 1998.

"H Testing Process", Jon Ebacher, VP, Power Gen Technology, May 8, 1998.

"Heavy–Duty & Aeroderivative Products" Gas Turbines, Brochure, 1998.

"MS7001H/MS9001H Gas Turbine, gepower.com website for PowerGen Europe" Jun. 1–3 going public Jun. 15, (1995).

"New Steam Cooling System is a Key to 60% Efficiency For GE "H" Technology Combined–Cycle Systems", Press Information, Press Release, 95–NRR16, May 16, 1995, H Technology/pp. 1–3.

"Overview of GE's H Gas Turbine Combined Cycle", Jul. 1, 1995 to Dec. 31, 1997.

"Power Systems for the 21$^{st}$ Century—"H" Gas Turbine Combined Cycles", Thomas C. Paul et al., Report.

"Power–Gen '96 Europe", Conference Programme, Budapest, Hungary, Jun. 26–28, 1996.

"Power–Gen International", 1998 Show Guide, Dec. 9–11, 1998, Orange County Convention Center, Orlando, Florida.

"Press Coverage following 1995 product announcement"; various newspaper clippings relating to improved generator.

"Proceedings of the Advanced Turbine Systems Annual Program Review Meeting", vol. 1, "Industrial Advanced Turbine Systems Program Overview", D.W. Esbeck, p. 3–13, Oct., 1995.

"Proceedings of the Advanced Turbine Systems Annual Program Review Meeting", vol. 1, "H Gas Turbine Combined Cycle", J. Corman, p. 14–21, Oct., 1995.

"Proceedings of the Advanced Turbine Systems Annual Program Review Meeting", vol. 1, "Overview of Westinghouse's Advanced Turbine Systems Program", Bannister et al., p. 22–30, Oct., 1995.

"Proceedings of the Advanced Turbine Systems Annual Program Review Meeting", vol. 1, "Allison Engine ATS Program Technical Review", D. Mukavetz, p. 31–42, Oct., 1995.

"Proceedings of the Advanced Turbine Systems Annual Program Review Meeting", vol. 1, "Advanced Turbine Systems Program Industrial System Concept Development", S. Gates, p. 43–63, Oct., 1995.

"Proceedings of the Advanced Turbine Systems Annual Program Review Meeting", vol. 1, "Advanced Turbine System Program Phase 2 Cycle Selection", Latcovich, Jr., p. 64–69, Oct., 1995.

"Proceedings of the Advanced Turbine Systems Annual Program Review Meeting", vol. 1, "General Electric ATA Program Technical Review Phase 2 Activities", Chance et al., p. 70–74, Oct., 1995.

"Proceedings of the Advanced Turbine Systems Annual Program Review Meeting", vol. 1, "Technical Review of Westinghouse's Advanced Turbine Systems Program", Diakunchak et al., p. 75–86, Oct., 1995.

"Proceedings of the Advanced Turbine Systems Annual Program Review Meeting", vol. 1, "Advanced Combustion Turbines and Cycles: An EPRI Perspective", Touchton et al., p. 87–88, Oct., 1995.

"Proceedings of the Advanced Turbine Systems Annual Program Review Meeting", vol. 1, "Advanced Turbine Systems Annual Program Review", William E. Koop, p. 89–92, Oct., 1995.

"Proceedings of the Advanced Turbine Systems Annual Program Review Meeting", vol. 1, "The AGTSR Consortium: An Update", Fant et al., p. 93–102, Oct. 1995.

"Proceedings of the Advanced Turbine Systems Annual Program Review Meeting", vol. 1, "Overview of Allison/AGTSR Interactions", Sy A. Ali, p. 103–106, Oct., 1995.

"Proceedings of the Advanced Turbine Systems Annual Program Review Meeting", vol. 1, "Design Factors for Stable Lean Premix Combustion", Richards et al., p. 107–113, Oct., 1995.

"Proceedings of the Advanced Turbine Systems Annual Program Review Meeting", vol. 1, "Ceramic Stationary as Turbine", M. van Roode, p. 114–147, Oct., 1995.

"Proceedings of the Advanced Turbine Systems Annual Program Review Meeting", vol. 1, "DOE/Allison Ceramic Vane Effort", Wenglarz et al., p. 148–151, Oct., 1995.

"Proceedings of the Advanced Turbine Systems Annual Program Review Meeting", vol. 1, "Materials/Manufacturing Element of the Advanced Turbine Systems Program", Karnitz et al., p. 152–160, Oct., 1995.

"Proceedings of the Advanced Turbine Systems Annual Program Review Meeting", vol. 1, "Land–Based Turbine Casting Initiative", Mueller et al., p. 161–170, Oct., 1995.

"Proceedings of the Advanced Turbine Systems Annual Program Review Meeting", vol. 1, "Turbine Airfoil Manufacturing Technology", Kortovich, p. 171–181, Oct., 1995.

"Proceedings of the Advanced Turbine Systems Annual Program Review Meeting", vol. 1, "Pratt & Whitney Thermal Barrier Coatings", Bornstein et al., p. 182–193, Oct., 1995.

"Proceedings of the Advanced Turbine Systems Annual Program Review Meeting", vol. 1, "Westinhouse Thermal Barrier Coatings", Goedjen et al., p. 194–199, Oct., 1995.

"Proceedings of the Advanced Turbine Systems Annual Program Review Meeting", vol. 1, "High Performance Steam Development", Duffy et al., p. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., p. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nadula et al. p. 233–248, Oct., 1995.

"Proceedings of the Advanced Turbine Systems Annual Program Review Meeting", vol. II, "Lean Premixed Flames for Low $No_x$ Combustors", Sojka et al., p. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., p. 276–280, Oct., 1995.

"Proceedings of ther Advanced Turbine Systems Annual Program Review Meeting", vol. II, "Advanced Turbine Cooling, Heat Transfer, and Aerodynamic Studies", Han et al., p. 281–309, Oct., 1995.

"Proceedings of the Advanced Turbine Systems Annual Program Review Meeting", vol. II, "Life Prediction of Advanced Materials for Gas Turbine Application", Zamrik et al., p. 310–327, Oct., 1995.

"Proceedings of the Advanced Turbine Systems Annual Program Review Meeting", vol. II, "Advanced Combustion Technologies for Gas Turbine Power Plants", Vandsburger et al., p. 328–352, Oct., 1995.

"Proceedings of the Advanced Turbine Systems Annual Program Review Meeting", vol. II, "Combustion Modeling in Advanced Gas Turbine Systems", Smoot et al., p. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. p. 371–390, Oct., 1995.

"Proceedings of the Advanced Turbine Systems Annual Program Review Meeting", vol. II, "Rotational Effects on Turbine Blade Cooling", Govatzidakia et al., p. 391–392, Oct., 1995.

"Proceedings of the Advanced Turbine Systems Annual Program Review Meeting", vol. II, "Manifold Methods for Methane Combustion", Yang et al., p. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410–414, Oct., 1995.

"Proceedings of the Advanced Turbine Systems Annual Program Review Meeting, vol. II", The Role of Reactant Unmixedness, Strain Rate, and Length Scale on Premixed Combustor Performance, Samuelsen et al., p. 415–422, Oct., 1995.

"Proceedings of the Advanced Turbine Systems Annual Program Review Meeting", vol. II, "Experimental and Computational Studies of Film Cooling With Compound Angle Injection", Goldstein et al., p. 423–451, Oct., 1995.

"Proceedings of the Advanced Turbine Systems Annual Program Review Meeting", vol. II, "Compatibility of Gas Turbine Materials with Steam Cooling", Desai et al., p. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, p. 465–473, Oct., 1995.

"Proceedings of the Advanced Turbine Systems Annual Program Review Meeting", vol II, Effects of Geometry on Slot–Jet Film Cooling Performance, Hyams et al., p. 474–496, Oct., 1995.

"Proceedings of the Advanced Turbine Systems Annual Program Review Meeting", vol. II, "Steam as Turbine Blade Coolant: Experimental Data Generation", Wilmsen et al., p. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., p. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., p. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., p. 529–538, Oct., 1995.

"Proceedings of the Advanced Turbine Systems Annual Program Review Meeting", vol. II, "Bond Strength and Stress Measurements in Thermal Barrier Coatings", Gell et al.., p. 539–549, Oct., 1995.

"Proceedings of the Advanced Turbine Systems Annual Program Review Meeting", "Active Control of Combustion Instabilities in Low $NO_x$ Gas Turbines", Zinn et al., p. 550–551,, Oct., 1995.

"Proceedings of the Advanced Turbine Systems Annual Program Review Meeting", vol. II, "Combustion Instability Modeling and Analysis", Santoro et al., p. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560–565, Oct., 1995.

"Proceedings of the Advanced Turbine Systems Annual Program Review Meeting", vol. II, "Heat Pipe Turbine Vane Cooling", Langston et al., p. 566–572, Oct., 1995.

"Proceedings of the Advanced Turbine Systems Annual Program Review Meeting", vol. II, "Improved Modeling Techniques for Turbomachinery Flow Fields", Lakshminarayana et al., p. 573–581, Oct., 1995.

"Proceedings of the Advanced Turbine Systems Annual Program Review Meeting", "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, p. 3–16, Nov., 1996.

"Proceedings of the Advanced Turbine Systems Annual Program Review Meeting", "Power Needs in the Chemical Industry", Keith Davidson, p. 17–26, Nov., 1996.

"Proceedings of the Advanced Turbine Systems Annual Program Review Meeting", "Advanced Turbine Systems Program Overview", David Esbeck, p. 27–34, Nov., 1996.

"Proceedings of the Advanced Turbine Systems Annual Program Review Meeting", "Westinghouse's Advanced Turbine Systems Program", Gerard McQuiggan, p. 35–48, Nov., 1996.

"Proceedings of the Advanced Turbine Systems Annual Program Review Meeting", "Overview of GE's H Gas Turbine Combined Cycle", Cook et al., p. 49–72, Nov., 1996.
"Proceedings of the Advanced Turbine Systems Annual Program Review Meeting", "Allison Advanced Simple Cycle Gas Turbine System", William D. Weisbrod, p. 73–94, Nov., 1996.
"Proceedings of the Advanced Turbine Systems Annual Program Review Meeting", "The AGTSR Industry–University Consortium", Lawrence P. Golan, p. 95–110, Nov., 1996.
"Proceedings of the Advanced Turbine Systems Annual Program Review Meeting", "$NO_x$ and CO Emissions Models for Gas–Fired Lean–Premixed Combustion Turbines", A. Mellor, p. 111–122, Nov., 1996.
"Proceedings of the Advanced Turbine Systems Annual Program Review Meeting", "Methodologies for Active Mixing and Combustion Control", Uri Vandsburger, p. 123–156, Nov., 1996.
"Proceedings of the Advanced Turbine Systems Annual Program Review Meeting", "Combustion Modeling in Advanced Gas Turbine Systems", Paul O. Hedman, p. 157–180, Nov., 19967.
"Proceedings of the Advanced Turbine Systems Annual Program Review Meeting", "Manifold Methods for Methane Combustion", Stephen B. Pope, p. 181–188, Nov., 1996.
"Proceedings of the Advanced Turbine Systems Annual Program Review Meeting", "The Role of Reactant Unmixedness, Strain Rate, and Length Scale on Premixed Combustor Performance", Scott Samuelsen, p. 180–210, Nov., 1996.
"Proceedings of the Advanced Turbine Systems Annual Program Review Meeting", "The Role of Swirl and Momentum Distribution on Temperature Distribution in Premixed Flames", Ashwani K. Gupta, p. 211–232, Nov., 1996.
"Proceedings of the Advanced Turbine Systems Annual Program Review Meeting", "Combustion Instability Studies Application to Land–Based Gas Turbine Combustors", Robert J. Santoro, p. 233–252.
"Proceedings of the Advanced Turbine Systems Annual Program Review Meeting", Active Control of Combustion Instabilities in Low $NO_x$ Turbines, Ben T. Zinn, p. 253–264, Nov., 1996.
"Proceedings of the Advanced Turbine Systems Annual Program Review Meeting", "Life Prediction of Advanced Materials for Gas Turbine Application," Sam Y. Zamrik, p. 265–274, Nov., 1996.
"Proceedings of the Advanced Turbine Systems Annual Program Review Meeting", "Combustion Chemical Vapor Deposited Coatings for Thermal Barrier Coating Systems", W. Brent Carter, p. 275–290, Nov., 1996.
"Proceedings of the Advanced Turbine Systems Annual Program Review Meeting", "Compatibility of Gas Turbine Materials with Steam Cooling", Vimal Desai, p. 291–314, Nov., 1996.
"Proceedings of the Advanced Turbine Systems Annual Program Review Meeting", "Bond Strength and Stress Measurements in Thermal Barrier Coatings", Maurice Gell, p. 315–334, Nov., 1996.
"Proceedings of the Advanced Turbine Systems Annual Program Review Meeting", "Advanced Multistage Turbine Blade Aerodynamics, Performance, Cooling and Heat Transfer", Sanford Fleeter, p. 335–336, Nov., 1996.
"Proceedings of the Advanced Turbine Systems Annual Program Review Meeting", "Flow Characteristics of an Intercooler System for Power Generating Turbines", Ajay K. Agrawal, p. 357–370, Nov., 1996.
"Proceedings of the Advanced Turbine Systems Annual Program Review Meeting", "Improved Modeling Techniques for Turbomachinery Flow Fields", B. Lakshiminarayana, p. 371–392, Nov., 1996.
"Proceedings of the Advanced Systems Annual Program Review Meeting", "Development of an Advanced 3d & Viscous Aerodynamic Design Method for Turbomachine Components in Utility and Industrial Gas Turbine Applications", Thong Q. Dang, p. 393–406, Nov., 1996.
"Proceedings of the Advanced Turbine Systems Annual Program Review Meeting", "Advanced Turbine Cooling, Heat Transfer, and Aerodynamic Studies", Je–Chin Han, p. 407–426, Nov., 1996.
"Proceedings of the Advanced Turbine Systems Annual Program Review Meeting", "Heat Transfer in a Two–Pass Internally Ribbed Turbine Blade Coolant Channel with Vortex Generators", S. Acharya, p. 427–446.
"Proceedings of the Advanced Turbine Systems Annual Program Review Meeting", "Experimental and Computational Studies of Film Cooling with Compound Angle Injection", R. Goldstein, p. 447–460, Nov., 1996.
"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461–470, Nov., 1996.
"Proceedings of the Advanced Turbine Systems Annual Program Review Meeting", "Steam as a Turbine Blade Coolant: External Side Heat Transfer", Abraham Engeda, p. 471–482, Nov., 1996.
"Proceedings of the Advanced Turbine Systems Annual Program Review Meeting", "Flow and Heat Transfer in Gas Turbine Disk Cavities Subject to Nonuniform External Pressure Field", Ramendra Roy, p. 483–498, Nov., 1996.
"Proceedings of the Advanced Turbine Systems Annual Program Review Meeting", "Closed–Loop Mist/Steam Cooling for Advanced Turbine Systems", Ting Wang, p. 499–512, Nov., 1996.
"Proceedings of the Advanced Turbine Systems Annual Program Review Meeting", "Heat Pipe Turbine Vane Cooling", Langston et al., p. 513–534, Nov., 1996.
"Proceedings of the Advanced Turbine Systems Annual Program Review Meeting", "EPRI's Combustion Turbine Program: Status and Future Directions", Arthur Cohn, p. 535,–552 Nov., 1996.
"Proceedings of the Advanced Turbine Systems Annual Program Review Meeting", "ATS Materials Support", Michael Karnitz, p. 553–576, Nov., 1996.
"Proceedings of the Advanced Turbine Systems Annual Program Review Meeting", "Land Based Turbine Casting Initiative", Boyd A. Mueller, p. 577–592, Nov., 1996.
"Proceedings of the Advanced Turbine Systems Annual Program Review Meeting", "Turbine Airfoil Manufacturing Technology", Charles S. Kortovich, p. 593–622, Nov., 1996.
"Proceedings of the Advanced Turbine Systems Annual Program Review Meeting", "Hot Corrosion Testing of TBS's", Norman Bornstein, p. 623–631, Nov., 1996.
"Proceedings of the Advanced Turbine Systems Annual Program Review Meeting", "Ceramic Stationary Gas Turbine", Mark van Roode, p. 633–658, Nov., 1996.

"Proceedings of the Advanced Turbine Systems Annual Program Review Meeting", "Western European Status of Ceramics for Gas Turbines", Tibor Bornemisza, p. 659—670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's Gas Turbine—High Efficiency, Low Cost of Electricity and Low Emissions", Roger Schonewald and Patrick Marolda, (no date available).
"Testing Program Results Validate GE's Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos. DOE/MC/31176—5628.
"Utility Advanced Turbine System (ATS) Technology Readiness Testing—Phase3", Document #666274, Oct. 1, 1996–Sep. 30, 1997, Publication Date, Dec. 31, 1997, Report Nos.: DOE/MC/31176—10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Nos.:DOE/MC/31176—5340.
"Utility Advanced Turbine System (ATS) Technology Readiness Testing and Pre–Commercial Demonstration—Phase 3", Document #486132, Apr. 1–Jun. 1, 1976, Publication Date, Dec. 31, 1996, Report Nos. DOE/MC/31176—5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos.: DOE/MC/31176—5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos.:DOE/MC/31176—8.
"Utility Advanced Turbine System (ATS) Technology Readiness Testing and Pre–Commercial Demonstration" Jan. 1–Mar. 31, 1996, DOE/MC–31176—5338.
"Utility Advanced Turbine Systems (ATS) Technology Readiness Testing: Phase 3R", Document #756552, Apr. 1–Jun. 30, 1999, Publication Date, Sep. 1, 1999, Report Nos.: DE—FC21–95MC31176–23.
"Utility Advanced Turbine System (ATS) Technology Readiness Testing.", Document #656823, Jan. .1–Mar. 31, 1998, Publication Date, Aug. 1, 1998, Report Nos.: DOE/MC/31176–17.
"Utility Advanced Turbine Systems (ATS) Technology Readiness Testing and Pre–Commercial Demonstration", Annual Technical Progress Report, Reporting Period: Jul. 1, 1995–Sep. 30, 1996.
"Utility Advanced Turbine Systems (ATS) Technology Readiness Testing", Phase 3R, Annual Technical Progress Report, Reporting Period: Oct. 1, 1997–Sep. 30, 1998.
"Utility Advanced Turbine Systems (ATS) Technology Readiness Testing", Document #750405, Oct. 1–Dec. 30, 1998, Publication Date: May 1, 1999, Report Nos.:DE–FC21–95MC31176–20.
"Utility Advanced Turbine Systems (ATS) Technology Readiness Testing", Document #1348, Apr. 1–Jun. 29, 1998, Publication Date Oct. 29, 1998, Report Nos. DE–FC21–95MC31176—18.
"Utility Advanced Turbine Systems (ATS) Technology Readiness Testing—Phase 3", Annual Technical Progress Report, Reporting Period: Oct. 1, 1996–Sep. 30, 1997.
"Utility Advanced Turbine Systems (ATS) Technology Readiness Testing and Pre–Commercial Demonstration", Quarterly Report, Jan. 1–Mar. 31, 1997, Document #666275, Report Nos: DOE/MC/31176–07.
"Proceedings of the 1997 Advanced Turbine Systems", Annual Program Review Meeting, Oct. 28–29, 1997.

* cited by examiner

CLOSED CIRCUIT STEAM COOLED TURBINE SHROUD AND METHOD FOR STEAM COOLING TURBINE SHROUD

This invention was made with Government support under Government Contract No. DE-FC21-95-MC31176 awarded by the Department of Energy. The Government has certain rights in this invention.

BACKGROUND OF THE INVENTION

The present invention relates to the cooling of turbine shrouds and, more particularly, to an apparatus for the impingement cooling of turbine shrouds as well as a system for flowing a cooling medium, in series, through several cooling cavities of a turbine shroud in a single, closed circuit.

Shrouds in an industrial gas turbine engine are located over the tips of the bucket. The shrouds assist in creating the annulus that contains the hot gas path air used by the buckets to produce rotational motion and, therefore, power. Thus, the shrouds are used to form the gas path of the turbine section of the engine. In advanced gas turbine designs, it has been recognized that the temperature of the hot gas flowing past the turbine components could be higher then the melting temperature of the metal. It is therefore necessary to establish a cooling scheme to protect the hot gas path components during operation.

Typical turbine shrouds are cooled by conduction, impingement cooling, film cooling or combinations of the above. More specifically, one method for cooling turbine shrouds employs an air impingement plate which has a multiplicity of holes for flowing air through the impingement plate at relatively high velocity due to a pressure difference across the plate. The high velocity air flow through the holes strikes and impinges on the component to be cooled. After striking and cooling the component, the post-impingement air finds its way to the lowest pressure sink.

Cooling air usage in a gas turbine is very costly for performance and emissions. However, as noted above, high technology engines produce high firing temperatures and the hot gas path components need to be actively cooled to be able to withstand the high gas path temperatures encountered under these circumstances.

Steam has been demonstrated to be a desired alternative cooling media for cooling gas turbine parts, particularly for combined-cycle plants. However, because steam has a higher heat capacity than the combustion gas, it is inefficient to allow coolant steam to mix with the hot gas stream. Consequently, it is desirable to maintain cooling steam inside the hot gas path components in a closed circuit. Using a closed circuit cooling system achieves the objectives of greater performance with less emissions.

U.S. Pat. No. 5,391,052, the disclosure of which is incorporated herein by this reference, describes apparatuses and methods for impingement cooling of turbine components, particularly turbine shrouds using steam as a cooling medium. U.S. Pat. No. 5,480,281, the disclosure of which is incorporated herein by this reference, provides an apparatus for impingement cooling turbine shrouds in a manner to reduce cross flow effects as well as a system for flowing a cooling medium, in series, through a pair of cooling cavities of the turbine shroud in a single flow circuit. While the apparatuses and methods disclosed in these patents afford effective steam cooling of turbine shrouds, there remains a continuing need for improving turbine shroud cooling while minimizing the amount of cooling media required and reducing cross flow effects.

BRIEF SUMMARY OF THE INVENTION

The present invention provides an improved closed cooling flow circuit for cooling turbine shrouds which provides for flowing a cool medium through a plurality of cooling chambers defined in the cooling cavity of the shroud so as to achieve a series of impingement cooling operations to maximize the cooling of the wall of the shroud exposed to the hot gas path and to minimize detrimental cross flow effects without reducing the area that is subject to impingement cooling.

The closed circuit cooling configuration described hereinbelow may be used with any cooling medium. However, in the presently preferred embodiment, the cooling medium is steam and thus steam will generally be referred to hereinbelow in a non-limiting manner as the cooling medium.

The invention is embodied, therefore, in an apparatus in which steam is brought on board into the outer shroud and spilt so as to be directed to the respective inner shrouds. Within each inner shroud, the steam or other cooling medium is impinged on the shroud inner surface opposite the hot gas path surface of the inner shroud. The post impingement steam flows into a second chamber of the inner shroud to again be impinged on the shroud inner surface for impingement cooling of that portion of the inner shroud. In the presently preferred, exemplary embodiment, the flow of post impingement steam and re-impingement of the inner shroud surface is then repeated through third and fourth chambers of the inner shroud. The spent steam is then returned to the system for being reused in the cycle. The system described hereinbelow is particularly adapted for a combined cycle system installation.

The present invention improves engine performance and reduces engine emissions while still maintaining the program requirements of part life and cost effectiveness.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
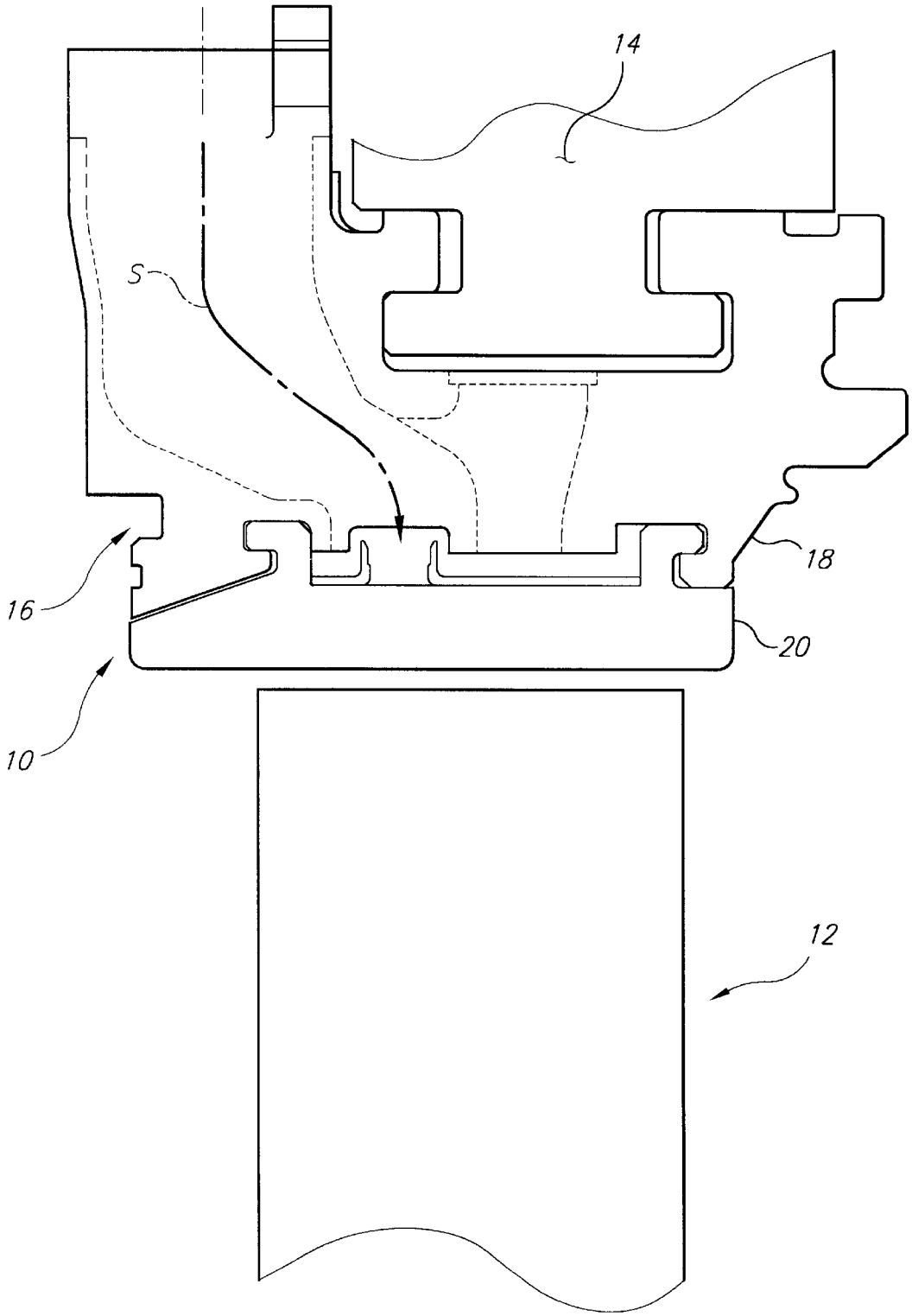
FIG. 1 is a schematic elevational view of a stage 1 shroud as disposed in a gas turbine.

The shroud system which surrounds the buckets forming the gas path is composed of a number of outer shrouds which are the carriers of at least one inner shroud. In the illustrated example, one outer shroud and two inner shrouds make up one shroud assembly and forty-two (42) such shroud assemblies make up one shroud set. FIG. 1 illustrates a shroud assembly 10 disposed radially outside the stage 1 buckets 12, only one of which is shown in FIG. 1. Also shown in FIG. 1 is the turbine shell interface 14, nozzle hook interface 16 and the inflow of cooling media shown by dash dot line S. As noted above, the closed circuit cooling configuration described hereinbelow may be used with any cooling medium. However, in the presently preferred embodiment the cooling medium is steam and thus steam will generally be referred to hereinbelow in a non-limiting manner as the cooling medium.

Figure 2:
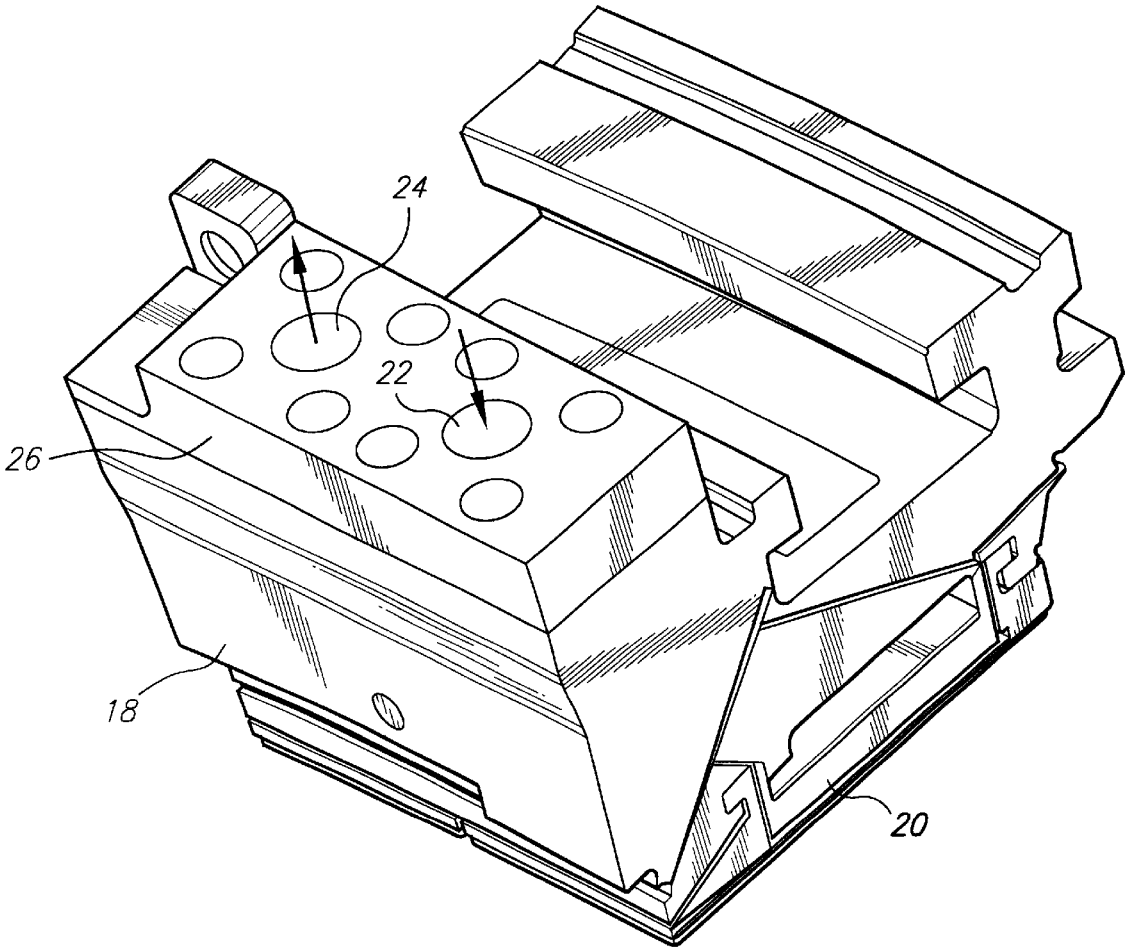
FIG. 2 is a perspective view of a steam cooled shroud assembly embodying the invention.

FIG. 2 shows in greater detail the assembly of the outer shroud 18 and first and second inner shrouds 20 in this exemplary embodiment. The steam inlet port is shown at 22 whereas the outlet or exit port is designated 24. The inlet and exit ports are formed in the outer cover to the outer shroud 18.

Figure 3:
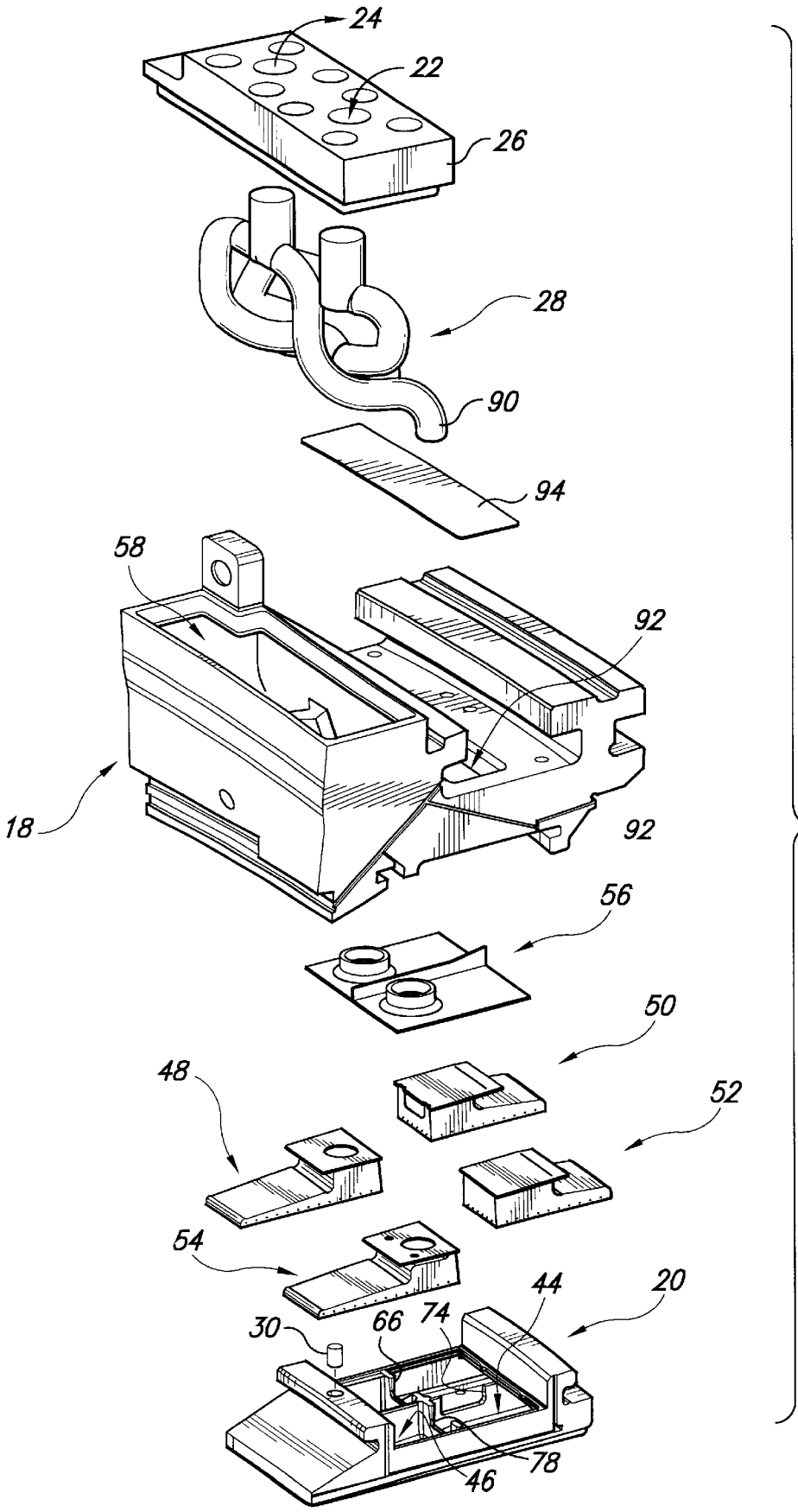
FIG. 3 is an exploded perspective view of the assembly of FIG. 2.

FIG. 3 shows this exemplary embodiment of the invention in greater detail. As noted above, the steam inlet port 22 and steam outlet port 24 are defined in outer cover 26. This particular system has steam tubes or piping 28 internal to the outer shroud that interfaces between the inlet and exit ports and the inner shroud interfaces for flowing the steam to respective inner shrouds, and returning spent cooling media, as described in greater detail below. This piping is enclosed in the outer shroud during shroud assembly.

Only one of the inner shrouds 20 is shown in FIG. 3 although, as noted above, in this exemplary embodiment, two inner shrouds are associated with each outer shroud 18. The inner shroud is engaged with the outer shroud in a conventional manner and in this example an inner shroud anti rotation pin 30 extends therebetween. The inner shroud is partitioned by ribs or partition walls 32, 34, 36, 38 as shown in greater detail in FIG. 4 to define four cooling chambers 40, 42, 44, 46. An impingement baffle inserts 48, 50, 52, 54 is disposed in each of these four chambers, as described in greater detail below, and an inner shroud cover plate 56 is provided to over lie the impingement baffles and to communicate with the respective cooling media tubes 28, 90 which extend through a compartment 58 therefor defined in the outer shroud 18. The cover plate 56 thus closes the chambers 40, 42, 44, 46 of the inner shroud 20 and controls/limits the cooling media inflow to and outflow from the inner shroud chambers.

Each impingement baffle divides its respective cooling chamber into a first, upstream compartment, and a second, downstream compartment. In the illustrated embodiment the impingement baffle insert defines an interior space that comprises the upstream chamber. Furthermore, in the illustrated embodiment, the second, downstream compartment is the volume of the respective chamber that surrounds the impingement baffle insert, but is predominantly defined between the impingement baffle insert and the radially inner wall of the respective chamber. Each impingement baffle insert has a plurality of flow openings defined therethrough for communicating cooling medium from the first compartment through those openings into the second compartment for impingement cooling of radially inner wall of the chamber; which is also the radially inner wall of the shroud assembly 10.

Thus, as illustrated, steam is brought on board through an interface at the forward end of the outer shroud 18. The steam is then carried through the steam piping 28 and split between the two inner shrouds 20 associated with the respective outer shroud 18. In the inner shroud 20, the steam enters the first chamber 40 of the four illustrated chambers, more specifically a first,upstream compartment 60 thereof defined by the impingement baffle 48 received therewithin. The cooling steam is impinged through the impingement holes 62 on the bottom surface, and in this example also on the side wall, of the impingement baffle 48 and is impinged upon the inner surface of the inner shroud radially inner wall 64.

The post impingement steam then flows from the first chamber 40 to the second chamber 42. As shown, the impingement baffle 48 of the first chamber is spaced from the rearward wall 32 that separates the first and second chambers 40;, 42 so as to allow post impingement cooling media to flow therebetween. One or more apertures, such as a cooling media aperture 66 is defined in wall 32 so as to allow the flow of that post impingement cooling media into the second chamber 42.

Figure 4:
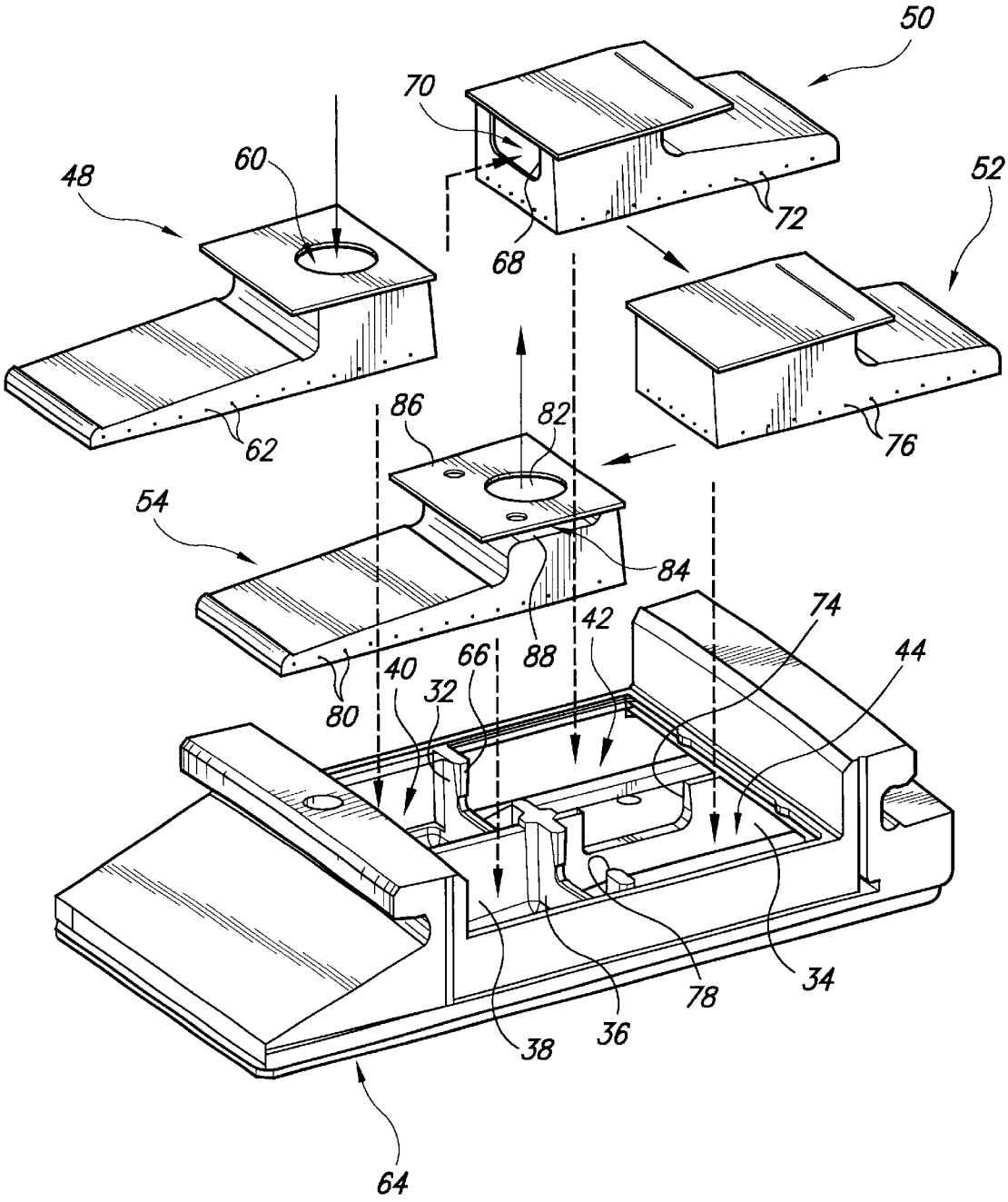
FIG. 4 is an exploded perspective view of the stage 1 inner shroud assembly.

As shown in FIG. 4, a cooling media inlet 68 is defined in the impingement baffle 50 of the second chamber 42 to receive the flow of cooling media from the first chamber 40 into the first, upstream compartment 70 of the second chamber that is defined therewithin. The cooling media then flows through holes 72 to be again impinged onto the inner surface of the inner shroud radially inner wall 64.

The impingement baffle 50 of the second chamber 42 is spaced from the rib or wall 34 separating the second and third chambers 42, 44 so as to allow the post impingement cooling media to flow therebetween and then through the cutout or aperture(s) 74 defined in wall 34. An aperture (not shown) is defined in the impingement baffle 52 of the third chamber 44 so that the cooling media will flow into the upstream compartment of the third chamber, defined within the impingement baffle 52. The cooling media flows through holes 76 to again impinge on the inner shroud inner surface for further cooling thereof.

The flow of the cooling media through the inner shroud continues as the cooling steam flows through an aperture or cutout 78 in the wall 36 disposed between the third and fourth chambers 44, 46 into the impingement baffle 54 of the fourth, and in this embodiment final, cooling chamber 46. The cooling media is once again impinged by flowing through holes 80, to impinge against the inner surface of the inner shroud radially inner wall. The spent cooling steam thereafter flows to the steam exit 82 through a gap 84 defined between the exit plate 86 and the upper wall 88 of the impingement baffle 54, as shown. The steam flows through the exhaust passage defined by exit tube 90 to be combined with the spent cooling media from the second inner shroud (not shown in FIG. 4) and exits through the steam piping 28 to an interface at the forward end of the outer shroud where it is returned to the combined cycle system.

As mentioned above, the illustrated system has piping 28 internal to the outer shroud 18 that interfaces between the inlet and exit ports 22, 24 and the inner shroud cover plate 56. This piping is enclosed in the outer shroud during the assembly of the shroud fabrication. An access hole 92 is provided in the outer shroud to access the piping connection to the inner shroud to inspect the connection to ensure that the connection is satisfactory. This access has been covered by a plate 94, as shown in FIG. 3, to complete the shroud cooling system.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Impingement cooling apparatus for a turbine shroud assembly having inner and outer walls spaced from one another to define a cooling cavity therebetween, comprising:

partition walls provided in said cavity to define at least four cooling chambers within said cavity, each said cooling chamber having a cooling medium inlet and a cooling medium outlet and defining a cooling medium flow path therethrough; an impingement baffle being disposed in each said chamber to define upstream and downstream compartments therewithin, each said impingement baffle having a plurality of flow openings therethrough for communicating cooling medium between said compartments through said openings; each said upstream compartment being in flow communication with the respective cooling medium inlet and each said downstream compartment being in flow communication with the respective cooling medium outlet;

a supply passage in communication with a first of said cooling chambers for supplying cooling medium to said upstream compartment of said first chamber for flow through the openings of the impingement baffle thereof into said downstream compartment of said first chamber for impingement cooling of said inner wall;

an exhaust passage in communication with a fourth of said cooling chambers for exhausting post-impingement cooling medium from said downstream compartment of said fourth chamber.

2. An impingement cooling apparatus as in claim 1, wherein said turbine shroud assembly comprises an outer shroud and at least one inner shroud, a said cooling cavity being defined in each said inner shroud, said supply passage being defined through said outer shroud for conducting cooling medium to a cooling medium inlet of said at least one inner shroud and wherein said exhaust passage extends through said outer shroud.

3. An impingement cooling apparatus as in claim 1, wherein at least one of said impingement baffles comprises an impingement baffle insert defining an interior space and having an inlet for flowing cooling media into said interior space, said interior space defining said upstream compartment of said respective chamber.

4. An impingement cooling apparatus as in claim 1, wherein each said impingement baffle comprises an impingement baffle insert defining an interior space and having an inlet for flowing cooling media into said interior space, said interior space defining said upstream compartment of said respective chamber.

5. An impingement cooling apparatus as in claim 1, wherein a first said partition wall is disposed between said first cooling chamber and a second said cooling chamber, a cooling media aperture being defined in said first partition wall for flowing cooling medium from said first chamber to said second chamber, said impingement baffle disposed in said first chamber being spaced from said first partition wall so that post impingement cooling media flows between said impingement baffle and said first partition wall and through said cooling media aperture to said second chamber.

6. An impingement cooling apparatus as in claim 5, wherein said impingement baffle disposed in said second chamber comprises an impingement baffle insert defining an interior space and having an inlet for flowing cooling media into said interior space, said interior space defining said upstream compartment of said second chamber, said cooling media inlet of said impingement baffle of said second chamber being disposed in flow communication with said cooling media aperture in said first partition wall, whereby said post impingement cooling media flowing through said cooling media aperture in said first partition wall flows substantially solely into said interior space of said impingement baffle insert of said second chamber.

7. A system for cooling a turbine shroud comprising:

shroud housing defining a plurality of chambers;

a first chamber of said plurality of chambers having an inlet for receiving cooling medium and a cooling medium outlet, said first chamber having an impingement baffle disposed therein to define first and second compartments therewithin, said first compartment of said first chamber being in flow communication with said inlet thereof and said second compartment of said first chamber being in flow communication with said outlet thereof; said impingement baffle having a plurality of flow openings therethrough for communicating cooling medium from said first compartment through said openings into said second compartment for impingement cooling of a wall of said first chamber;

a second chamber of said plurality of chambers having an impingement baffle disposed therein to define first and second compartments therewithin, said first compartment of said second chamber being in flow communication with said outlet of said first chamber for receiving cooling medium from said first chamber, said impingement baffle having a plurality of flow openings therethrough for communicating cooling medium from said first compartment through said openings into said second compartment for impingement cooling of a wall of said second chamber, said second chamber having an outlet for post-impingement cooling medium to exit said second compartment thereof;

a third chamber of said plurality of chambers having an impingement baffle disposed therein to define first and second compartments, said first compartment of said third chamber being in flow communication with said outlet of said second chamber for receiving cooling medium from said second chamber, said impingement baffle having a plurality of flow openings therethrough for communicating cooling medium from said first compartment through said openings into said second compartment for impingement cooling of a wall of said third chamber, said third chamber having an outlet for post-impingement cooling medium to exit said second compartment thereof;

a fourth chamber of said plurality of chambers having an impingement baffle disposed therein to define first and second compartments, said first compartment of said fourth chamber being in flow communication with said outlet of said third chamber for receiving cooling medium from said third chamber, said impingement baffle having a plurality of flow openings therethrough for communicating cooling medium from said first compartment through said openings into said second compartment for impingement cooling of a wall of said fourth chamber, said fourth chamber having an outlet for post-impingement cooling medium to exit said second compartment thereof;

an inlet port in communication with said inlet of said first chamber for flowing cooling medium thereto; and an exit port in communication with said outlet of said fourth chamber for exhausting post-impingement cooling medium therefrom.

8. A system as in claim 7, wherein said turbine shroud comprises an outer shroud and at least one inner shroud, each said inner shroud defining a said shroud housing, a supply passage being defined through said outer shroud for conducting cooling medium to said inlet of said fist chamber and wherein an exhaust passage extends through said outer shroud for exhausting post-impingement flow from said outlet of said fourth chamber.

9. A system as in claim 7, wherein at least one of said impingement baffles comprises an impingement baffle insert defining an interior space and having an inlet for flowing cooling media into said interior space, said interior space defining said first compartment of said respective chamber.

10. A system as in claim 7, wherein each said impingement baffle comprises an impingement baffle insert defining an interior space and having an inlet for flowing cooling media into said interior space, said interior space defining said first compartment of said respective chamber.

11. A system as in claim 7, wherein a first partition wall is disposed between said first chamber and said second chamber, a cooling media aperture being defined in said first partition wall for flowing cooling medium from said first chamber to said second chamber, said impingement baffle disposed in said first chamber being spaced from said first partition wall so that post impingement cooling media flows between said impingement baffle and said first partition wall and through said cooling media aperture to said second chamber.

12. A system as in claim 11, wherein said impingement baffle disposed in said second chamber comprises an impingement baffle insert defining an interior space and having an inlet for flowing cooling media into said interior space, said interior space defining said first compartment of said second chamber, said cooling media inlet of said impingement baffle of said second chamber being disposed in flow communication with said second compartment of said first chamber, whereby said post impingement cooling media flows substantially solely from said second compartment of said first chamber into said interior space of said impingement baffle insert of said second chamber.

13. A system as in claim 7, wherein a first partition wall is disposed between said first chamber and said second chamber, a cooling media aperture being defined in said first partition wall for flowing cooling medium from said first chamber to said second chamber, and wherein said impingement baffle disposed in said second chamber comprises an impingement baffle insert defining an interior space and having an inlet for flowing cooling media into said interior space, said interior space defining said first compartment of said second chamber, said cooling media inlet of said impingement baffle of said second chamber being disposed in flow communication with said cooling media aperture in said first partition wall, whereby said post impingement cooling media flowing through said cooling media aperture in said first partition wall flows substantially solely into said interior space of said impingement baffle of second chamber.

14. A method of cooling a turbine shroud by cooling medium impingement comprising the steps of:

providing a turbine shroud having at least four cooling chambers defined therein, an inlet port for flowing cooling medium thereto, and an exit port for exhausting spent cooling medium therefrom;

flowing cooling medium through said inlet port and into a first chamber of said plurality of chambers within the shroud;

flowing cooling medium through a plurality of openings defined in an impingement baffle dividing the first chamber into a first compartment and a second compartment;

directing the cooling medium flowing through said openings across said second compartment of said first chamber for impingement against a radially inner wall of the shroud to cool said wall;

flowing post-impingement cooling medium from said first chamber through an aperture defined in a wall thereof and into a second chamber of said plurality of chambers within the shroud;

flowing cooling medium through a plurality of openings defined in an impingement baffle dividing the second chamber into a first compartment and a second compartment;

directing the cooling medium flowing through said openings across said second compartment of said second chamber for impingement against said radially inner wall of the shroud to cool said wall;

flowing post-impingement cooling medium from said second chamber through an aperture defined in a wall thereof and into a third chamber of said plurality of chambers within the shroud;

flowing cooling medium through a plurality of openings defined in an impingement baffle dividing the third chamber into a first compartment and a second compartment;

directing the cooling medium flowing through said openings across said second compartment of said third chamber for impingement against said radially inner wall of the shroud to cool said wall;

flowing post-impingement cooling medium from said third chamber through an aperture defined in a wall thereof and into a fourth chamber of said plurality of chambers within the shroud;

flowing cooling medium through a plurality of openings defined in an impingement baffle dividing the fourth chamber into a first compartment and a second compartment;

directing the cooling medium flowing through said openings across said second compartment of said fourth chamber for impingement against said radially inner wall of the shroud to cool said wall;

flowing post-impingement cooling medium from said fourth chamber through an exit defined in a wall thereof; and exhausting spent cooling medium through said exit port.

15. A method as in claim 14, wherein said step of providing a turbine shroud comprises providing an assembly including an outer shroud and at least one inner shroud, each said inner shroud having a said plurality of cooling chambers defined therewithin, a supply passage being defined through said outer shroud for conducting cooling medium to from said inlet port to said inner shroud, and an exhaust passage being defined through said outer shroud for exhausting post-impingement flow from said exit of said fourth chamber.

16. A method as in claim 14, wherein at least one of said impingement baffles comprises an impingement baffle insert defining an interior space and having an inlet for flowing cooling media into said interior space, said interior space defining said first compartment of said respective chamber.

17. A method as in claim 14, wherein each said impingement baffle comprises an impingement baffle insert defining an interior space and having an inlet for flowing cooling media into said interior space, said interior space defining said first compartment of said respective chamber.

18. A method as in claim 14, wherein a first partition wall is disposed between said first chamber and said second chamber, said aperture of said first chamber being defined in said first partition wall for flowing cooling medium from said first chamber to said second chamber, said impingement baffle disposed in said first chamber being spaced from said first partition wall so that post impingement cooling media flows between said impingement baffle and said first partition wall and through said aperture to said second chamber.

19. A method as in claim 14, wherein said impingement baffle disposed in said second chamber comprises an impingement baffle insert defining an interior space and having an inlet for flowing cooling media into said interior space, said interior space defining said first compartment of said second chamber, said cooling media inlet of said impingement baffle of said second chamber being disposed in flow communication with said second compartment of said first chamber, whereby said post impingement cooling media flows substantially solely from said second compartment of said first chamber into said interior space of said impingement baffle insert of second chamber.

20. A method as in claim 14, wherein a first partition wall is disposed between said first chamber and said second chamber, wherein said aperture of said first chamber is defined in said first partition wall for flowing cooling medium from said first chamber to said second chamber, and wherein said impingement baffle disposed in said second chamber comprises an impingement baffle insert defining an interior space and having an inlet for flowing cooling media into said interior space, said interior space defining said first compartment of said second chamber, said cooling media inlet of said impingement baffle of said second chamber being disposed in flow communication with said aperture in said first partition wall, whereby said post impingement cooling media flowing through said aperture in said first partition wall flows substantially solely into said interior space of said impingement baffle of second chamber.

* * * * *